United States Patent [19]

Minton

[11] 4,342,133

[45] Aug. 3, 1982

[54] VACUUM CLEANER AIR FLOW SENSING ARRANGEMENT

[75] Inventor: Keith G. Minton, North Canton, Ohio

[73] Assignee: The Hoover Company, North Canton, Ohio

[21] Appl. No.: 243,066

[22] Filed: Mar. 12, 1981

[51] Int. Cl.[3] ..... A47L 9/19

[52] U.S. Cl. ..... 15/339; 55/274; 55/DIG. 34; 116/264

[58] Field of Search ..... 15/339, 412; 116/264, 116/268; 55/274, DIG. 34

[56] References Cited

U.S. PATENT DOCUMENTS

| | | | |
|---|---|---|---|
| 595,876 | 12/1897 | Gay | 73/228 |
| 1,829,582 | 10/1931 | Carson . | |
| 2,019,895 | 11/1935 | Dow . | |
| 2,389,603 | 11/1945 | Dollinger | 73/228 |
| 2,409,078 | 10/1946 | Swann . | |
| 2,459,194 | 1/1949 | Sparklin | 15/352 |
| 3,210,793 | 10/1965 | Waters | 15/339 |
| 3,577,869 | 5/1971 | Hosokawa et al. | 55/361 |
| 3,763,635 | 10/1973 | Schmitz | 55/374 |
| 3,796,097 | 3/1974 | Ruskin | 73/228 |
| 3,914,994 | 10/1975 | Banner | 73/118 |
| 3,962,918 | 6/1976 | Rosaen | 73/228 |

FOREIGN PATENT DOCUMENTS

| | | |
|---|---|---|
| 689153 | 6/1964 | Canada . |
| 786506 | 6/1968 | Canada . |
| 2124761 | 3/1972 | Fed. Rep. of Germany . |

OTHER PUBLICATIONS

Reed Switch Application Notes, G. Electric, TPP 6166, Jan. 1973.

*Primary Examiner*—Chris K. Moore

*Attorney, Agent, or Firm*—Gerald H. Kreske; A. Burgess Lowe

[57] ABSTRACT

An air flow sensing arrangement is disclosed for use in a vacuum cleaner. A plenum chamber or cavity established by a first wall and a second wall is provided adjacent to a fan inlet with all air from a bag chamber being directed radially inward therethrough toward an aperture in the first wall communicating with the fan inlet. The second wall is provided with openings adjacent to its outer periphery so that air is proportionally directed into the cavity along a plurality of paths. An air distribution chamber is established by the second wall and a secondary filter is supported on the second wall. Air is distributed by the distribution chamber about an entire outer surface of a wall portion of the second wall so as to maintan a consistent proportion of air flow through the openings into the cavity in the event irregular filter clogging occurs. A flow sensing device including a pivoting vane having a magnet thereon is disposed within the cavity so as to be within a path of air flowing through the openings. Air impinging against the vane causes it to pivot in an arcuate path to indicate a predetermined air flow level. A switch means is mounted in a position so as to be tangential to arcuate movement of the magnet during a portion of its movement with the switch means being actuated by the magnet when air flow in the cleaner drops to a predetermined low level thereby indicating a condition such as, for example, a full filter bag, low power setting on the cleaner and/or clogged hose.

13 Claims, 6 Drawing Figures

VACUUM CLEANER AIR FLOW SENSING ARRANGEMENT

BACKGROUND OF THE INVENTION

This invention relates generally to air flow sensing, and more particularly, to air flow sensin arrangements for use in vacuum cleaners.

In vacuum cleaners, it is particularly important to maintain a predetermined minimum air flow level in order to assure that a vacuum cleaner is performing effectively. A full filter bag condition and/or a clogged hose condition in a vacuum cleaner impedes air flow through the cleaner and makes the cleaner ineffective for cleaning. Thus, it is desirable to provide an air flow sensing arrangement for informing an operator of a cleaner air flow problem so that the operator can take corrective action such as, for example, installing a clean filter bag or increasing motor power where an adjustable power control is available.

In order to provide a simple and economical air flow sensing arrangement to provide an indication of a low flow condition in a vacuum cleaner, it is generally desirable to provide a sensing element to sense only a portion of the total air flow so as to provide an indication of total air flow within the vacuum cleaner. However, vacuum cleaners have air flowing in a multitude of paths therein which may vary from unit to unit depending on the geometry of the cleaners. Thus, a sensing arrangement which may be suitable for one cleaner may not provide the desired accuracy in another cleaner because the sensing arrangement may be sensing a different proportion of the total cleaner air flow. A calibration provision could be provided but this generally adds complexity to a sensing arrangement and requires a calibration step in the vacuum cleaner fabrication process. Therefore, it would be advantageous to develop a simple and economical arrangement for sensing air flow conditions in a vacuum cleaner wherein a consistent proportion of the total air flow is sensed to provide an accurate and reliable indication of a predetermined total air flow without requiring calibration.

Further, vacuum cleaners often have very limited space available for accommodating an air flow sensing arrangement. Therefore, elaborate flow sensing arrangements are often not desirable from a space standpoint as well as from a cost standpoint. Thus, it would be advantageous to develop a flow sensing arrangement which could be easily integrated within available space and that could assure that a consistent proportion of total air is sensed to provide an accurate indication of a predetermined total air flow.

Still further, it would be desirable to provide such an improved air flow sensing arrangement with an accurate and reliable means of providing a remote indication of a predetermined flow condition. Air flow sensing arrangements often utilize the sensor itself for indication via a transparent window and/or some type of flag or indicator mechanically actuated by the sensor. However, such arrangements are often limited in mounting flexibility and/or visual indicating capability. Thus, it would be advantageous to provide an electrical switching arrangement which can provide reliable switching in a vacuum cleaner environment to provide a remote indication of a predetermined flow condition.

SUMMARY OF THE INVENTION

Accordingly, a general object of the present invention is to provide a new and improved air flow sensing arrangement for use in a vacuum cleaner.

A more specific object of the present invention is to provide a new and improved air flow sensing arrangement which can be economically fabricated and yet, provide an accurate and reliable indication of a predetermined air flow level without requiring calibration.

Another object of the present invention is to provide a new and improved air flow sensing arrangement wherein a consistent proportion of total air flow is sensed to provide an accurate indication of a predetermined total air flow level.

Still another object of the present invention is to provide a new and improved air flow sensing arrangement which can easily be incorporated into available space in a vacuum cleaner.

A further object of the present invention is to provide a new and improved air flow sensing arrangement having a switching arrangement which can provide reliable switching in a vacuum cleaner environment and provide a remote indication of a predetermined flow condition.

In carrying out the invention in one form thereof, a vacuum cleaner is provided with an air flow sensing arrangement for sensing a consistent proportion of total air flow to provide an indication of a predetermined low air flow. A plenum chamber is provided which is disposed adjacent to a fan inlet of a vacuum cleaner. The plenum chamber has all the air from a bag chamber directed radially inwardly therethrough and then axially from the plenum chamber via an aperture in a first wall of the plenum chamber. The plenum chamber is also provided with a second wall which at least in part provides openings located adjacent to its outer periphery so that air is proportionally directed into and through the plenum chamber along a plurality of paths. An air distribution means is also provided for distributing air about an outer surface of a wall portion of the second wall to maintain the proportionality of air being directed into the plenum chamber.

In one form, the air distribution means includes an air distribution chamber located between the wall portion and a secondary filter spaced in an axial direction from the wall portion toward the bag chamber. The distribution chamber distributes air about the entire wall portion so as to minimize the effect of any irregular clogging condition of the secondary filter and thus, maintains a consistent proportional air flow through the openings located adjacent to the periphery of the second wall.

An air flow sensor is provided which includes a pivoting vane mounted within the plenum chamber so as to be responsive to air flowing in at least one of the plurality paths. A means responsive to pivotal movement of the vane provides a signal indicative of a predetermined air flow level. In one embodiment, the vane has a magnet integrally mounted therewith and a magnet responsive switch is provided and positioned so as to be actuated by the magnet at a predetermined low air flow level. Air flow against the vane causes the vane to pivot in an arcuate path with the magnet and the magnet responsive switch being moved out of an actuating relationship when the air flow exceeds the predetermined air flow level. When air flow drops to a predetermined low level, the vane pivots downwardly, due to its own weight and the weight of the magnet thereon, causing the magnet to actuate the magnet responsive switch thereby providing a signal which may be utilized to activate a remotely mounted indicating light.

DESCRIPTION OF THE PREFERRED EMBODIMENT

Figure 1:
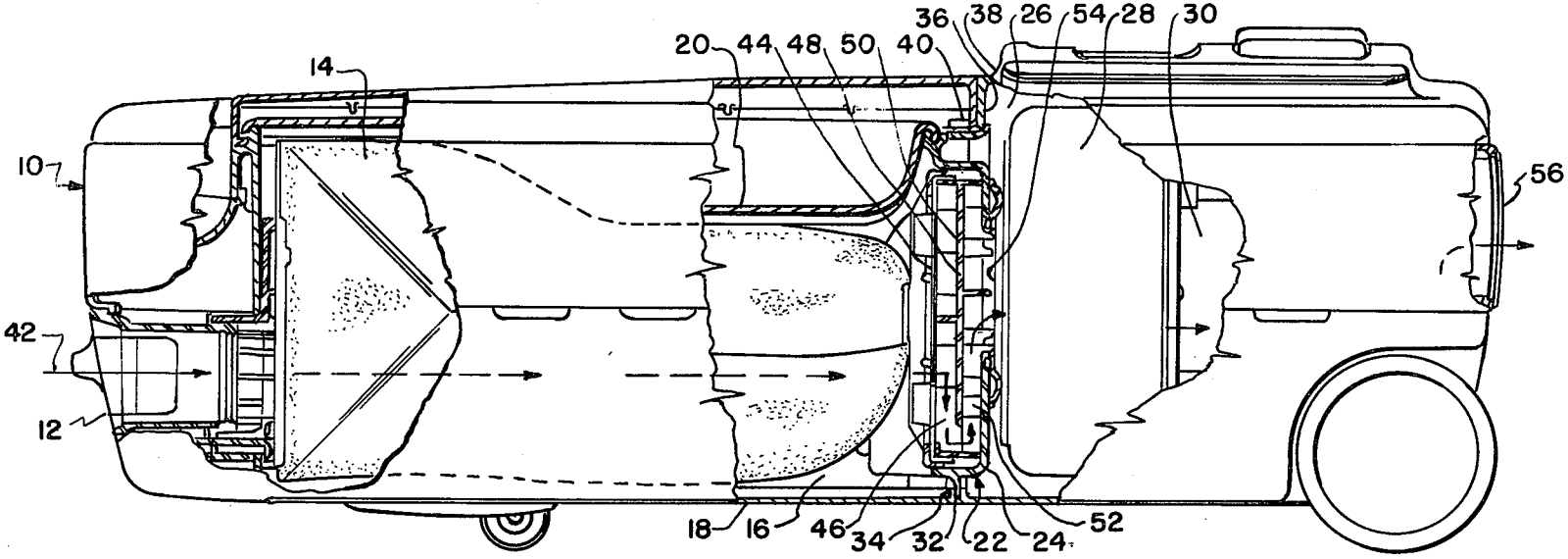
FIG. 1 is a side elevational view, with parts thereof broken away, of a vacuum cleaner embodying the invention in one form thereof.

Referring to FIG. 1, there is illustrated a vacuum cleaner 10 of one type which embodies features of the present invention in one preferred form. As illustrated, the vacuum cleaner includes an air inlet 12 having a dust separating device, illustrated as dust filter bag 14, connected thereto and disposed within a bag chamber 16. The bag chamber is formed in part by a wall 18 of the cleaner housing and a removable tool tray wall 20.

An air flow sensing arrangement, referred to generally by reference number 22, is disposed within the vacuum cleaner with a first wall or bulkhead 24 thereof separating the bag chamber 16 from a chamber 26 containing fan 28 and motor 30. The fan and motor are connected to each other for creating a flow of air through the cleaner. The first wall is held in position at the bottom portion of the cleaner by an interfitting transversely extending rib 32 of the first wall disposed within a channel 34 of the cleaner housing wall 18. At the top of the cleaner, the first wall is attached to angled portion 36 of top cleaner wall 38 by screws such as, for example, screw 40 although it could be attached by any suitable means.

During operation, air flows through the vacuum cleaner 10 as generally indicated by arrows 42 in FIG. 1. Dust laden air flows axially into the cleaner via the inlet opening 12. The dust filter bag 14 filters the incoming air to remove dust and dirt therefrom. The air then flows through the wall of the dust filter bag and into the bag chamber 16. From the bag chamber, the air flows axially through a secondary filter 44 to an air distribution chamber 46 established between the secondary filter and a wall portion 48 which is spaced in an axial direction from the first wall 24 toward the bag chamber. Air is distributed about an outer surface 50 of the wall portion and then flows into a cavity or plenum chamber 52 as will be discussed more fully hereinbelow. The air flows radially inward through the cavity or plenum chamber and then axially to an inlet 54 of the fan 28. Upon discharge from the fan, and air flows from the vacuum cleaner via an exhaust 56 located in the rear portion of the cleaner.

Figure 2:
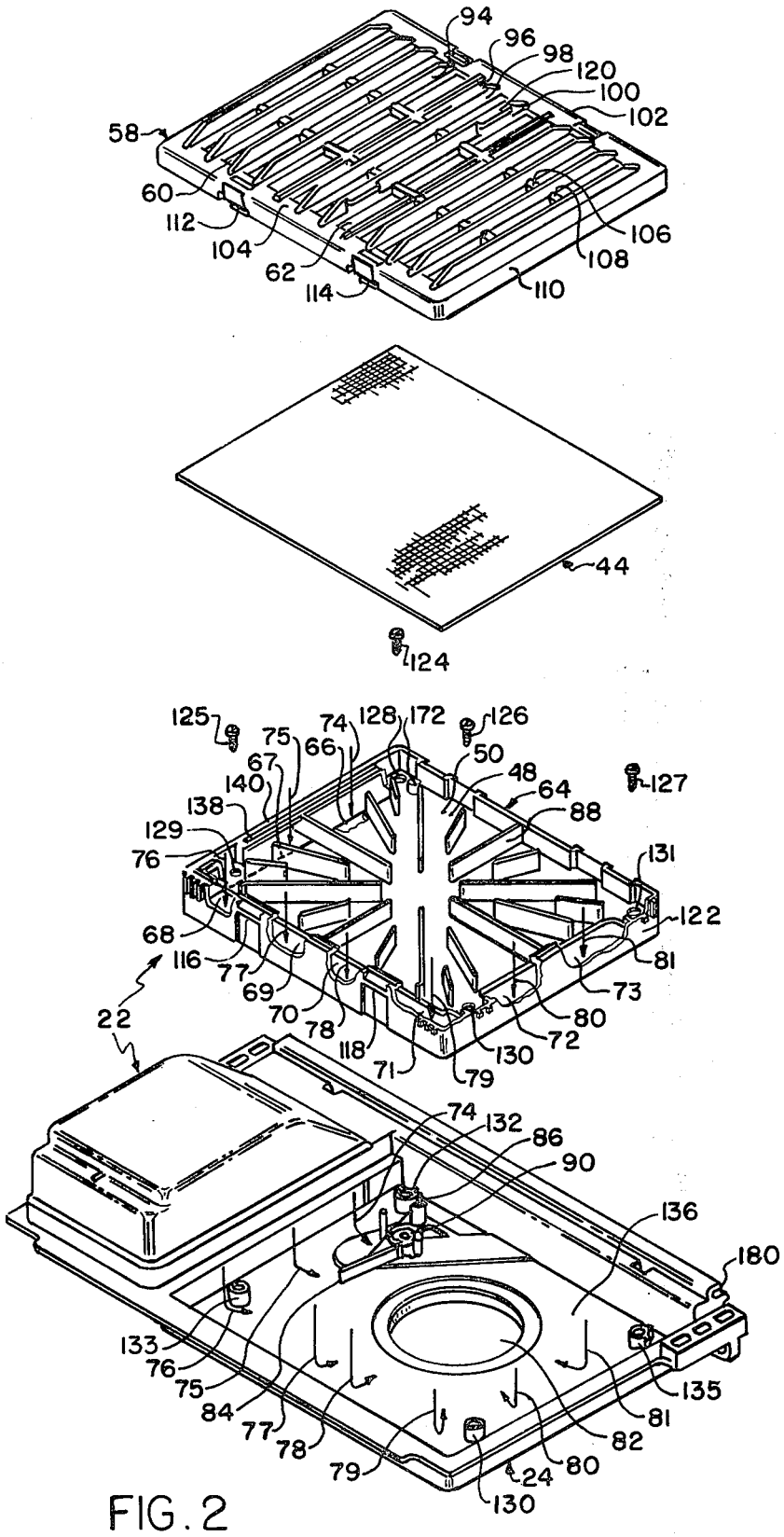
FIG. 2 is an exploded view of an air flow sensing arrangement in combination with a secondary filter arrangement.

FIG. 2 illustrates assembly and air flow details of the flow sensing arrangement 22 in combination with a secondary filter unit comprising the secondary filter 44 and a filter support means, illustrated as grill or cap 58. After leaving the bag chamber 16 (FIG. 1), air flows through a plurality of openings such as, for example, openings 60 and 62, in the grill and then the air flows through the secondary filter for removing any dirt or dust not removed by the filter dust bag 14 (FIG. 1).

After passing through the secondary filter 44, air impinges on the outer surface 50 of the wall portion 48 of a second wall or cover 64. Air is distributed about the outer surface and flows toward a plurality of openings or apertures 66 through 73, located adjacent to the periphery of the second wall. The plurality of openings provide air flow along a multiple or a plurality of paths as indicated by arrows 74 through 81, from the outer surface into the cavity or plenum 52 (FIG. 1) established between the first wall 24 and the wall portion of the second wall. After flowing axially through the openings, the air flows radially inward along the plurality of paths toward aperture or opening 82 in the first wall which communicates with the fan inlet 54 (FIG. 1) thereby allowing the air to leave the cavity or plenum chamber and flow in an axial direction into the fan inlet.

As indicated hereinabove, the primary purpose of the air flow sensing arrangement 22 is to provide an accurate and reliable measurement of a predetermined air flow level within a vacuum cleaner. A predetermined low air flow value or level such as, for example, twenty cubic feet per minute, indicates that a condition exists such as, for example, a clogged hose, low motor power, or a full dust filter bag, that warrants attention and corrective action by a cleaner operator.

In order to sense and measure air flow, an air flow sensor or sensing means, shown as sail or vane 84, is pivotally mounted on the first wall 24 so as to be within at least one path of air flowing in the cavity or plenum chamber 52 (FIG. 1) established between the first wall and the wall portion 48. In the illustrated arrangement, air flow through the opening 66 along the path 74 and a portion of the air flow through the opening 67 along the path 75 impinges upon or moves laterally against the sail to cause pivotable movement or displacement thereof about pivot pin 86. The peripheral openings 66 through 73 provide air flow through each of their respective paths which is proportional to the total air flow. Thus, the sail is exposed to a proportion of the total air flow so that displacement thereof provides an indication of the total air flow.

In order to assure that the sail 84 sees a consistent proportion of the total air flow or that proportional air flow through the openings 66 through 73 is maintained, the wall portion 48 is axially spaced from the secondary filter 44 in their assembled relationship thereby establishing the air distribution chamber 46 (FIG. 1) therebetween. A plurality of ribs such as, for example, rib 88, maintain the spacing and permit air flow about the entire outer surface 50 of the wall portion. Thus, in the event that the secondary filter clogs irregularly, air will be distributed across the entire outer surface toward the openings so as to minimize the effect of irregular filter clogging on the proportion of air being sensed by the sail.

When the portion of air flowing against the sail 84 indicates that the total air flow exceeds a predetermined low value or level such as, for example, 20 cubic feet per minute, the upward movement of the sail causes magnet 90, integrally mounted thereon, to deactivate a magnet responsive switch means, shown as reed switch 92 (FIGS. 5 and 6), as will be discussed more fully hereinbelow. When air flow decreases or drops to the predetermined low level or below, gravitational forces on the sail, with the magnet counterweight thereon, cause the sail to pivot downward to again actuate the reed switch thereby providing a signal indicating that air flow has decreased to the predetermined low air flow level. As is readily apparent, the sail weight, sail configuration, the proportion of air being sensed, and/or the magnet weight may be modified to provide sail deflection to indicate any desired predetermined air flow level.

In somewhat more detail, the secondary filter unit comprises the secondary filter 44 and the filter support or holding means shown as the cap or grill 58. In this embodiment, the grill was formed as a one piece molded plastic unit from ABS plastic. The grill includes a plurality of members such as, for example, grill members 94, 96, 98 and 100 extending between a top portion 102 and a bottom portion 104. Air admitting openings, such as, for example, the openings 60 and 62 are established between the grill members. A plurality of sections, such as, for example, sections 106 and 108 extend transverse to the grill members thereby forming a lattice type arrangement.

The secondary filter 44, which may be, for example, Fiberloc, style No. 548-01-012 made by Felter Company, is received within rim or angled side portion 110 which extends about the periphery of the grill 58. The grill is also provided with four inward extending locking or retaining tabs such as, for example, retaining tabs 112 and 114. The retaining tabs slide over respective cammed ridges such as, for example, cammed ridges 116 and 118, on the second wall 64 for attaching the grill to the second wall. The grill is also provided with four finger hold tabs, such as, for example, tab 120 located on grill member 100, for facilitating removal of the grill from the second wall.

As can be seen in FIG. 2, the second wall 64 comprises the wall portion 48 and a skirt or rim portion 122 extending about the periphery of the wall portion. The second wall is attached to the first wall 24 by four screws 124–127 which extend through openings 128–131, respectively and are received in posts 132–135, respectively on the first wall. When assembled, the skirt seats against a recessed outer surface 136 of the first wall. Thus, the plenum chamber or cavity 52 (FIG. 1) is established for permitting air to flow radially therethrough toward the aperture or opening 82 in the first wall. In this embodiment, the second wall is formed as an integral one piece molded plastic unit formed of ABS plastic, but it is understood that it could be formed by assembling multiple pieces of plastic or other materials.

The peripheral skirt 122 is also provided with a ridge or raised portion 138 on parts of its top portion 140 which facilitates sealing when the secondary filter 44 and the grill 58 are assembled or interfitted with the second wall 64. As can be seen, the wall portion 48 is recessed from the top portion of the skirt. Thus, when the secondary filter and the grill are assembled with the second wall, the air distribution chamber 46 (FIG. 1) is established therebetween, and thereby providing an air distribution means for distributing air impinging on the outer surface 50 of the wall portion 48 about the entire outer surface toward the peripheral openings 66–73. The distributing of air flow across the entire outer surface, i.e., permitting a cross flow of air, maintains a consistent proportionality of air flow through the openings in the event the secondary filter clogs in an irregular or non-uniform manner.

Figure 3:
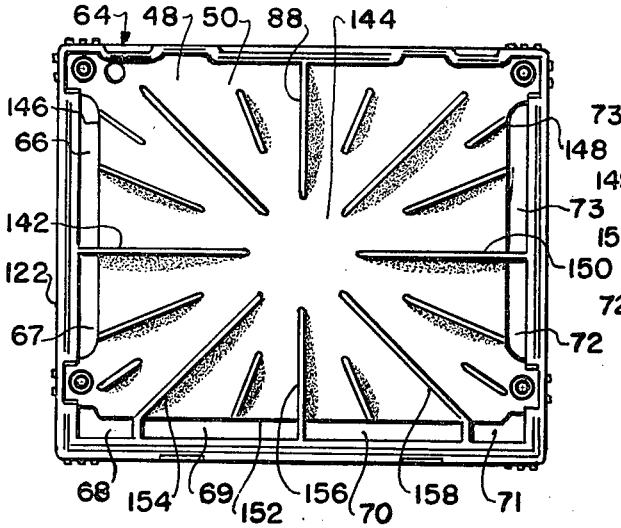
FIG. 3 is a front elevational view of a second wall of the air flow sensing arrangement illustrated in FIG. 2.

Referring to FIG. 3, the second wall 64 is provided with a plurality of ribs or vanes such as, for example, the rib 88, disposed about the outer surface 50 of the wall portion 48. The ribs provide support and spacing of the secondary filter in an axial direction away from the wall portion toward the bag chamber 16 (FIG. 1). Some of the ribs such as, for example, the rib 88 and rib 142, are integrally attached or connected to the skirt 122 and thus, serve to enhance the structural integrity of the second wall. Although the ribs in the illustrated arrangement are, for the most part, generally radially arranged on the outer surface, numerous other rib configurations or orientations could be utilized for supporting the secondary filter. However, it is desirable to arrange the ribs so as to permit a cross flow of air about the entire outer surface. In the illustrated arrangement, air is permitted to flow across the entire outer surface of the wall portion via center area 144 so as to compensate for any irregular or non-uniform clogging of the secondary filter.

Figure 4:
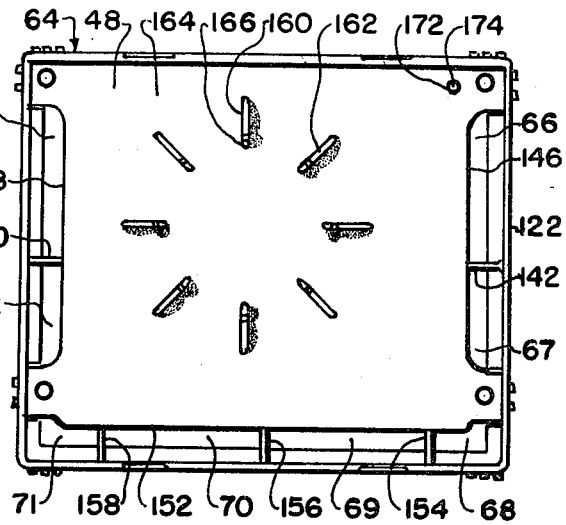
FIG. 4 is a rear elevational view of the second wall illustrated in FIGS. 2 and 3.

Referring to FIGS. 3 and 4 for further details, the air admitting openings 66 and 67, located adjacent to the periphery of the second wall 64, are established by recessed surface 146 of the wall portion 48, the skirt or rim 122 and the rib 142 which extends across the recessed surface to the skirt thereby establishing a partition between the two openings. The oppositely disposed openings 72 and 73 are similarly established by recessed surface 148, the skirt and rib 150. The openings 68, 69, 70 and 71 are established in a similar manner by outer surface 152 of the wall portion, the skirt and ribs 154, 156 and 158. Although the openings in the illustrated arrangement are established by the second wall, it should be readily apparent that modified arrangements could be provided wherein the second wall cooperates with surrounding cleaner casing structure to establish parts or boundaries of air admitting openings such as, for example, an arrangement wherein the second wall terminates short of surrounding casing structure. As can be seen in the illustrated arrangement, openings are provided only about a portion of the second wall, i.e., about three sides of the rectangularly shaped second wall. It is preferred not to have openings about the entire periphery in order to prevent air flow into the cavity 52 (FIG. 1) which would tend to produce a bias force against movement of the sail 84 (FIG. 2). That is, it is preferred to have openings arranged so that the portion of total air flow being sensed by the sail is impinging laterally thereagainst.

As can be seen in FIG. 4, the second wall 64 is also provided with a plurality of vanes such as, for example, vanes 160 and 162, on inner or rear surface 164 of the wall portion 48. The vanes are generally radially oriented and extend in an axial direction, i.e., outwardly from the sheet in FIG. 4. The vanes are provided with lips such as, for example, lip 166 on the vane 160. When the second wall is assembled to the first wall 24 illustrated in FIG. 5, the vanes about or seat against seal 168 which extends about the central aperture 82 of the first wall. The lips of the vanes abut inner surface 170 of the seal, and thus, the vanes help retain and maintain the seal in position. Further, the vanes provided additional support for the wall portion when assembled with the first wall thereby assuring maintenance of the axial spacing therebetween. Still further, the vanes assist in directing air into the central aperture. The wall portion is also provided with a post 172 (also see FIG. 2) having hollow portion or recess 174 open at the rear surface of the wall portion. The recess receives the pivot pin 86 (FIG. 5) therein.

Figure 5:
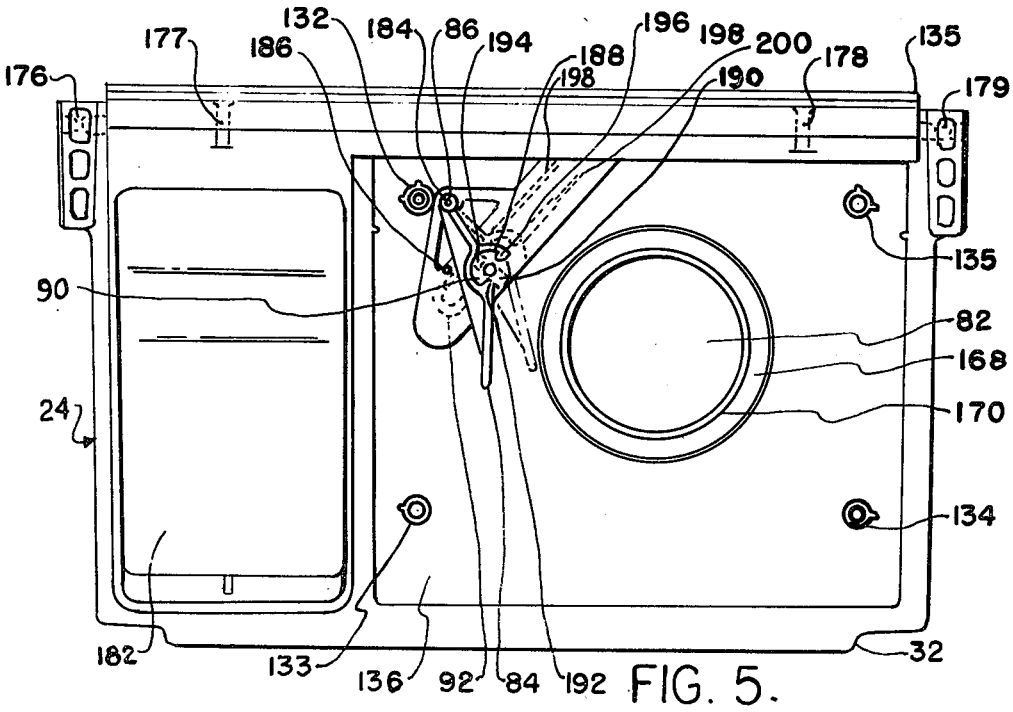
FIG. 5 is a front elevational view of a first wall of the flow sensing arrangement illustrated in FIG. 2.

Referring to FIG. 5 for further details, the first wall or bulkhead 84 is generally rectangular in shape in the illustrated embodiment. As mentioned previously, the first wall forms a partition between the bag chamber 16 (FIG. 1) and the fan/motor chamber 26 (FIG. 1). Screw accepting openings 176–179 are provided for mounting of the first wall within the vacuum cleaner 10 (FIG. 1). The first wall is also provided with the laterally extending rib or ledge 32 which interfits with the U-shaped portion 34 (FIG. 1) of the cleaner housing wall portion 18 (FIG. 1) for mounting within the cleaner. A U-shaped portion 180 (also see FIG. 2) is provided for accepting the removable tool tray 20 (FIG. 1) therein. The recessed outer surface 136 is also provided for accepting a mounting of the second wall 64 (FIG. 2) thereon via the screw accepting posts 132–135 as previously described. The illustrated bulkhead also has a hollow elevated portion 182 for accepting electrical materials which are not part of the present invention. In the illustrated arrangement, the bulkhead or first wall is formed as a one piece molded plastic unit of ABS plastic, but it is understood that it could be formed by the assembly of multiple pieces of plastic or other materials.

The outer surface 136 of the first wall 24 also has the flow sensing device or the sail 84 pivotally mounted thereon. The pivot pin 86, which may be formed of stainless steel, is press fit into a not shown opening in the first wall. The sail or vane has an opening 184 therein for receiving the pivot pin therethrough for establishing the pivoting mounting arrangement. The sail extends downwardly along the outer surface to form a pendulum which is free to pivot about the pivot pin in response to air flowing laterally thereagainst. Stop 186 is provided for limiting downward travel of the sail and the upward travel of the sail is limited by the vane 162 (FIG. 4).

The sail 84, which may be formed of molded plastic, is provided with a semicircular recess 188 for mounting of the magnet 90 at a location spaced from a vertical axis extending through the pivot pin 86. The magnet is generally circular or donut shaped and is provided with a recess portion 190 on a rear portion thereof. The magnet is held in position in the axial direction by tabs 192, 194 and 196 of the sail. The tab 194 fits within the recess 190 of the magnet which also fixes the circular orientation of the magnet. A switch means or means responsive to pivotal movement of the sail, shown as the magnet actuatable reed switch 92 having lead wires 198 and 200 extending therefrom, is mounted on the rear of the first wall 24. The reed switch is positioned relative to the arcuate movement path of the sail so that the switch is tangential and perpendicular to the arcuate movement path of the magnet at the desired operating point, i.e., the predetermined air flow level.

Two positions of the sail 84 are illustrated in FIG. 5. The position shown by dashed lines is a "high" or "normal" flow position wherein the reed switch 92 is deactuated. As air flow decreases to a predetermined low value such as, for example, 20 cubic feet per minute, gravitational forces on the sail resulting from the weight of the sail and the weight of the magnet 90 causes the sail to pivot downwardly to the predetermined low flow level position shown by solid lines. At the predetermined low flow position, the magnet 90 actuates the reed switch for providing a signal indicating that the predetermined low flow exists. The reed switch remains actuated when air flow decreases to values less than the predetermined value with the sail continuing its downward movement until encountering the stop 186.

Figure 6:
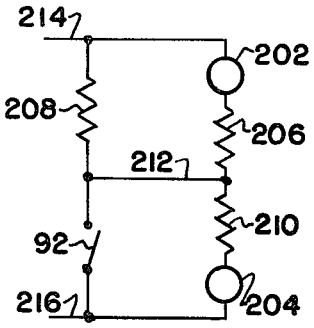
FIG. 6 is an electrical indicating circuit utilizing an air flow switch device illustrated in FIG. 5.

FIG. 6 illustrates an electrical circuit which may be utilized to provide a remote indication of air flow conditions. Two neon lights 202 and 204 which may be, for example, red and green, respectively, provide indications of "low" and "good" flow conditions. The light 202 is connected in series with trim resistor 206 with the two being connected in parallel with dropping resistor 208. The light 204 is connected in series with trim resistor 210 and both are connected in parallel with the previously described air flow switch or the reed switch 92. The above described light circuits are also connected in series with each other via wire 212 as illustrated, and power is supplied via wires 214 and 216.

With the air flow switch 92 in the open or deactuated position as illustrated, the resistor 208 effectively shunts the light 202 thereby allowing illumination of the light 204 to indicate that air flow exceeds the predetermined low air flow level. When air flow decreases to the predetermined low level, the air flow switch is actuated or closed thereby shunting the light 204 and allowing illumination of the light 202. The light 202 remains illuminated when air flow drops below the predetermined level thereby providing a visual indication that air flow is equal to or less than the predetermined air flow level. In one arrangement fabricated in accordance with FIG. 6, 220 volts were supplied to the circuit on the wires 214 and 216, and the resistors 206, 208 and 210 were 120 K ohms ½ watt, 39 K ohms 2 watt and 82 K ohms ½ watt respectively.

While there have been shown and described herein preferred embodiments of the present invention, it should be apparent to persons skilled in the art that numerous modifications may be made therein without departing from the true spirit and scope of the invention. Accordingly it is intended by the appended claims to cover all modifications which come within the spirit and scope of this invention.

What is claimed is:

1. A vacuum cleaner including:

(a) plenum chamber disposed adjacent to a fan inlet and having all air from a bag chamber directed radially inward therethrough and axially therefrom to the fan inlet;

(b) said plenum chamber including a first wall having at least one opening therein communicating with the fan inlet and a second wall having a wall portion thereof spaced axially from the first wall and in a direction toward the bag chamber;

(c) said second wall at least in part providing openings located adjacent to its outer periphery so that air is proportionally directed into and through said plenum chamber along a plurality of paths;

(d) an air distribution means for distributing air about an outer surface of the wall portion thereby maintaining the proportionality of air being directed into the plenum chamber;

(e) an air flow sensor including a pivoting vane disposed within the plenum chamber so as to be in at least one of the plurality of paths of air; and (f) means responsive to pivotal movement of the pivoting vane to provide a signal indicative of a predetermined air flow value.

2. A vacuum cleaner in accordance with claim 1 wherein the second wall is generally rectangular in shape with openings located adjacent to the outer periphery of three sides thereof.

3. A vacuum cleaner in accordance with claim 1 wherein the air distribution means includes a distribution chamber located adjacent to the outer surface for distributing air about the entire outer surface of the wall portion.

4. A vacuum cleaner in accordance with claim 1 further including a magnet integrally mounted with said pivoting vane for movement therewith.

5. A vacuum cleaner in accordance with claim 4 wherein said means responsive to pivotal movement of the pivoting vane includes a magnet actuatable switch responsive to the magnet during a portion of movement of the pivoting vane.

6. A vacuum cleaner comprising:

(a) a first wall disposed adjacent to a fan inlet and having at least one aperture therein communicating with the fan inlet;

(b) a second wall having a wall portion spaced from the first wall and in an axial direction toward a bag chamber to establish a cavity therebetween;

(c) a secondary filter spaced in an axial direction from an outer surface of the wall portion toward the bag chamber;

(d) said second wall at least in part providing apertures located adjacent to its outer periphery so as to provide proportional air flow into the cavity along a plurality of paths and thereby providing a radial inward flow of the air within the cavity toward the at least one aperture communicating with the fan inlet;

(e) said second wall and said secondary filter unit establishing an air distribution chamber for distributing air flow from the secondary filter toward the apertures located adjacent to the outer periphery of the second wall so as to maintain proportional air flow into the cavity; and (f) air flow sensor including a pivotally mounted vane disposed within the cavity so as to be in at least one of the plurality of paths of air flow and movable thereby to indicate a predetermined air flow value.

7. A vacuum cleaner in accordance with claim 6 further including rib members disposed between the outer surface of the wall portion and the secondary filter for maintaining axial spacing therebetween thereby permitting distribution of air about the entire outer surface for minimizing the effect of irregular clogging of the secondary filter on proportional air flow into the cavity.

8. A vacuum cleaner in accordance with claim 6 wherein the first wall also provides separation between a motor and fan chamber and the bag chamber.

9. A vacuum cleaner comprising:

(a) a first wall disposed adjacent to a fan inlet and having at least one aperture therein communicating with the fan inlet;

(b) a second wall having a wall portion spaced from the first wall and in an axial direction toward a bag chamber to establish a cavity therebetween;

(c) said second wall at least in part providing apertures located adjacent to its outer periphery so as to provide proportional air flow into the cavity along a plurality of paths and thereby providing a radial inward flow of the air within the cavity toward the at least one aperture communicating with the fan inlet;

(d) a vane pivotally mounted within the cavity so as to be responsive to air flowing in at least one of the paths;

(e) a magnet integrally mounted with said vane and movable in an arcuate path in response to air flow against the vane; and (f) switch means mounted in a position so as to be tangential to the arcuate path of the magnet during a portion of its movement, and actuatable by the magnet at a predetermined air flow level to provide a signal indicative of air flow.

10. A vacuum cleaner in accordance with claim 9 wherein said magnet is mounted on said vane at a location offset from a pivot point of the vane with the weight of the magnet biasing the vane toward a position indicative of lesser air flow.

11. A vacuum cleaner in accordance with claim 9 further including an indicating light responsive to said switch means to provide a visual signal indicating that air flow is equal to or less than the predetermined air flow level.

12. A vacuum cleaner in accordance with claim 11 further including a second indicating light responsive to said switch means to provide a visual signal indicating that air flow exceeds the predetermined air flow level.

13. A vacuum cleaner in accordance with claim 9 wherein the switching means includes a reed switch actuatable by the magnet at the predetermined air flow level.

* * * * *